US010559313B2

(12) United States Patent
Liu et al.

(10) Patent No.: US 10,559,313 B2
(45) Date of Patent: *Feb. 11, 2020

(54) SPEECH/AUDIO SIGNAL PROCESSING METHOD AND APPARATUS

(71) Applicant: HUAWEI TECHNOLOGIES CO., LTD., Shenzhen, Guangdong (CN)

(72) Inventors: Zexin Liu, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/457,165

(22) Filed: Jun. 28, 2019

(65) Prior Publication Data

US 2019/0318747 A1 Oct. 17, 2019

Related U.S. Application Data

(63) Continuation of application No. 16/021,621, filed on Jun. 28, 2018, now Pat. No. 10,360,917, which is a (Continued)

(30) Foreign Application Priority Data

Mar. 1, 2012 (CN) ..... 2012 1 0051672

(51) Int. Cl.
*G10L 19/00* (2013.01)
*G10L 19/083* (2013.01)
*G10L 19/02* (2013.01)

(52) U.S. Cl.
CPC ..... *G10L 19/00* (2013.01); *G10L 19/083* (2013.01); *G10L 19/0204* (2013.01)

(58) Field of Classification Search
CPC ..... G10L 19/0204; G10L 19/02; G10L 19/06; G10L 25/18; G10L 19/00; G10L 19/083
See application file for complete search history.

(56) References Cited

U.S. PATENT DOCUMENTS 6,606,591 B1 8/2003 Su
7,058,079 B1 6/2006 Gicquel et al.
(Continued)

FOREIGN PATENT DOCUMENTS

CN 101335002 A 12/2008
CN 101496101 A 7/2009
(Continued)

OTHER PUBLICATIONS

"G.729 based Embedded Variable bit-rate coder:An 8-32 kbit/s scable wideband coder bitstream interroperable withG.729; G.729.1(May 2006)", May 29, 2006, XP017404590, 98 pages.
(Continued)

*Primary Examiner* — Angela A Armstrong
(74) *Attorney, Agent, or Firm* — Fish & Richardson P.C.

(57) ABSTRACT

The present disclosure relates to speech/audio signal processing methods and apparatus. One example speech/audio signal processing method includes when a speech/audio signal switches bandwidth, obtaining an initial high frequency signal corresponding to a current frame of speech/audio signal, obtaining a time-domain global gain parameter of the initial high frequency signal, performing weighting processing on an energy ratio and the time-domain global gain parameter, using an obtained weighted value as a predicted global gain parameter, where the energy ratio is a ratio between energy of a historical frame of high frequency time-domain signal and energy of a current frame of initial high frequency signal, correcting the initial high frequency signal by using the predicted global gain parameter to obtain a corrected high frequency time-domain signal, and synthe-
(Continued)

sizing a current frame of narrow frequency time-domain signal and the corrected high frequency time-domain signal and outputting the synthesized signal.

14 Claims, 6 Drawing Sheets

Related U.S. Application Data continuation of application No. 15/616,188, filed on Jun. 7, 2017, now Pat. No. 10,013,987, which is a continuation of application No. 14/470,559, filed on Aug. 27, 2014, now Pat. No. 9,691,396, which is a continuation of application No. PCT/CN2013/072075, filed on Mar. 1, 2013.

(56) References Cited

U.S. PATENT DOCUMENTS

| | | | | |
|---|---|---|---|---|
| 7,191,123 | B1 | 3/2007 | Bessette et al. | |
| 9,691,396 | B2 * | 6/2017 | Liu | G10L 19/00 |
| 10,013,987 | B2 * | 7/2018 | Liu | G10L 19/00 |
| 10,360,917 | B2 * | 7/2019 | Liu | G10L 19/00 |
| 2003/0012221 | A1 | 1/2003 | El-Maleh et al. | |
| 2004/0243402 | A1 | 12/2004 | Ozawa | |
| 2007/0265837 | A1 | 11/2007 | Ehara | |
| 2008/0027718 | A1 | 1/2008 | Krishnan et al. | |
| 2009/0222261 | A1 | 9/2009 | Jung et al. | |
| 2010/0228557 | A1 | 9/2010 | Chen et al. | |
| 2011/0099004 | A1 | 4/2011 | Krishnan et al. | |
| 2011/0270614 | A1 | 11/2011 | Liu et al. | |
| 2017/0270933 | A1 | 9/2017 | Liu et al. | |

FOREIGN PATENT DOCUMENTS

| | | | |
|---|---|---|---|
| CN | 101499278 | A | 8/2009 |
| CN | 101751925 | A | 6/2010 |
| CN | 101964189 | A | 2/2011 |
| CN | 102044250 | A | 5/2011 |
| EP | 1898397 | A1 | 3/2008 |
| EP | 2485029 | A1 | 8/2012 |
| JP | 2002528777 | A | 9/2002 |
| JP | 2003044098 | A | 2/2003 |
| JP | 2009134260 | A | 6/2009 |
| JP | 2011112311 | A | 6/2011 |
| JP | 6010141 | B2 | 10/2016 |
| KR | 20090080777 | A | 7/2009 |
| RU | 2414009 | C2 | 3/2011 |
| WO | WO0025305 | A1 | 5/2000 |
| WO | WO2006028009 | A1 | 3/2006 |
| WO | WO2007000988 | A1 | 1/2007 |
| WO | WO2008076534 | A2 | 6/2008 |
| WO | WO2011027709 | A1 | 3/2011 |
| WO | WO2011050347 | A1 | 4/2011 |
| WO | WO2012110482 | A2 | 8/2012 |

OTHER PUBLICATIONS

H.W. Kim et al., "The Trend of G.729.1 Wideband Multi-codec Technology," ETRI Electronics and Telecommunications Trend Analysis vol. 21, No. 6 (Dec. 2006), 18 pages.

"Ragot S et al., ""ITU-T G.729.1 :AN 8-32 kbit/s Scable Coder Interoperable with G.729 for Wideband Telephony andVoice Over IP"", Apr. 15, 2007, XP031463903 , 4 pages".

Extended European Search Report issued in European Application No. 18199234.8 dated Jul. 30, 2019, 4 pages.

* cited by examiner

SPEECH/AUDIO SIGNAL PROCESSING METHOD AND APPARATUS

CROSS-REFERENCE TO RELATED APPLICATION

This application is a continuation of U.S. patent application Ser. No. 16/021,621, filed on Jun. 28, 2018, which is a continuation of U.S. patent application Ser. No. 15/616,188, filed on Jun. 7, 2017, now U.S. Pat. No. 10,013,987, which is a continuation of U.S. patent application Ser. No. 14/470,559, filed on Aug. 27, 2014, now U.S. Pat. No. 9,691,396, which is a continuation of International Application No. PCT/CN2013/072075, filed on Mar. 1, 2013. The International Application No. PCT/CN2013/072075 claims priority to Chinese Patent Application No. 201210051672.6, filed on Mar. 1, 2012. All of the afore-mentioned patent applications are hereby incorporated by reference in their entireties.

TECHNICAL FIELD

The present invention relates to the field of digital signal processing technologies, and in particular, to a speech/audio signal processing method and apparatus.

BACKGROUND

In the field of digital communications, transmission of voice, images, audio, and videos is needed in a wide range of applications such as a mobile phone call, an audio/video conference, broadcast television, and multimedia entertainment. Audio is digitized, and is transmitted from one terminal to another terminal by using an audio communications network. The terminal herein may be a mobile phone, a digital telephone terminal, or an audio terminal of any other type, where the digital telephone terminal is, for example, a VOIP telephone, an ISDN telephone, a computer, or a cable communications telephone. To reduce resources occupied by a speech/audio signal during storage or transmission, the speech/audio signal is compressed at a transmit end and then transmitted to a receive end, and at the receive end, the speech/audio signal is restored by means of decompression processing and is played.

In current multirate speech/audio coding, because of different network statuses, a network truncates bit streams at different bit rates, where the bit streams are transmitted from an encoder to the network, and at a decoder, the truncated bit streams are decoded into speech/audio signals of different bandwidths. As a result, the output speech/audio signals switch between different bandwidths.

Sudden switching between signals of different bandwidths causes obvious aural discomfort in human ears. Besides, because updating of states of filters during time-frequency transform or frequency-time transform generally requires the use of a parameter between consecutive frames, when some proper processing is not performed during bandwidth switching, an error may occur during the updating of these states, which causes some phenomena of abrupt energy changes and deterioration of aural quality.

SUMMARY

An objective of embodiments of the present invention is to provide a speech/audio signal processing method and apparatus, so as to improve aural comfort during bandwidth switching of speech/audio signals.

According to a first aspect of the present invention, a speech/audio signal processing method includes:

when a speech/audio signal switches from a wide frequency signal to a narrow frequency signal, obtaining an initial high frequency signal corresponding to a current frame of speech/audio signal;

obtaining a time-domain global gain parameter of the high frequency signal according to a spectrum tilt parameter of the current frame of speech/audio signal and a correlation between a narrow frequency signal of current frame and a narrow frequency signal of historical frame;

correcting the initial high frequency signal by using the time-domain global gain parameter, to obtain a corrected high frequency time-domain signal; and synthesizing a narrow frequency time-domain signal of current frame and the corrected high frequency time-domain signal and outputting the synthesized signal.

In a first possible implementation manner of the first aspect, wherein the obtaining a time-domain global gain parameter of the high frequency signal according to a spectrum tilt parameter of the current frame of speech/audio signal and a correlation between a narrow frequency signal of current frame and a narrow frequency signal of historical frame comprises:

classifying the current frame of speech/audio signal as a first type of signal or a second type of signal according to the spectrum tilt parameter of the current frame of speech/audio signal and the correlation between the narrow frequency signal of current frame and the narrow frequency signal of historical frame;

when the current frame of speech/audio signal is a first type of signal, limiting the spectrum tilt parameter to less than or equal to a first predetermined value, to obtain a spectrum tilt parameter limit value;

when the current frame of speech/audio signal is a second type of signal, limiting the spectrum tilt parameter to a value in a first range, to obtain a spectrum tilt parameter limit value; and using the spectrum tilt parameter limit value as the time-domain global gain parameter of the high frequency signal.

With reference to the first possible implementation manner of the first aspect, in a second possible implementation manner, wherein the first type of signal is a fricative signal, and the second type of signal is a non-fricative signal; when the spectrum tilt parameter tilt>5 and a correlation parameter cor is less than a given value, the narrow frequency signal is classified as a fricative signal, the rest being non-fricative signals; the first predetermined value is 8; and the first preset range is [0.5, 1].

With reference to anyone of the first aspect, the first possible implementation manner of the first aspect and the second possible implementation manner of the first aspect, in a third possible implementation manner, wherein the correcting the initial high frequency signal by using the time-domain global gain parameter, to obtain a corrected high frequency time-domain signal comprises:

performing weighting processing on an energy ratio and the time-domain global gain parameter, and using an obtained weighted value as a predicted global gain parameter, wherein the energy ratio is a ratio between energy of a historical frame of high frequency time-domain signal and energy of a current frame of initial high frequency signal; and correcting the initial high frequency signal by using the predicted global gain parameter.

With reference to anyone of the first aspect, the first possible implementation manner of the first aspect and the second possible implementation manner of the first aspect, in a fourth possible implementation manner, further comprising:

obtaining a time-domain envelope parameter corresponding to the initial high frequency signal, wherein the correcting the initial high frequency signal by using the time-domain global gain parameter comprises:

correcting the initial high frequency signal by using the time-domain envelope parameter and the time-domain global gain parameter.

According to a second aspect of the present invention, a speech/audio signal processing method includes:

when a speech/audio signal switches from a wide frequency signal to a narrow frequency signal, obtaining, by a decoder, an initial high frequency signal corresponding to a current frame of speech/audio signal;

obtaining, by the decoder, a time-domain global gain parameter of the initial high frequency signal according to a spectrum tilt parameter of the current frame of speech/audio signal and a correlation between a narrow frequency signal of the current frame and a narrow frequency signal of a historical frame;

performing, by the decoder, weighting processing on an energy ratio and the time-domain global gain parameter to obtain a, and using an obtained weighted value as a predicted global gain parameter, wherein the energy ratio is a ratio between energy of a historical frame of high frequency time-domain signal of a historical frame and energy of a current frame of the initial high frequency signal of the current frame;

correcting, by the decoder, the initial high frequency signal by using the predicted global gain parameter, to obtain a corrected high frequency time-domain signal; and synthesizing, by the decoder, a narrow frequency time-domain signal of the current frame and the corrected high frequency time-domain signal In a first possible implementation manner of the second aspect, wherein the obtaining a time-domain global gain parameter of the initial high frequency signal comprises:

obtaining the time-domain global gain parameter of the high frequency signal according to a spectrum tilt parameter of the current frame of speech/audio signal and a correlation between a narrow frequency signal of current frame and a narrow frequency signal of historical frame.

With reference to the first possible implementation manner of the first aspect, in a second possible implementation manner, wherein the obtaining the time-domain global gain parameter of the high frequency signal according to a spectrum tilt parameter of a current frame of speech/audio signal and a correlation between a narrow frequency signal of current frame and a narrow frequency signal of historical frame comprises:

classifying the current frame of speech/audio signal as a first type of signal or a second type of signal according to the spectrum tilt parameter of the current frame of speech/audio signal and the correlation between the narrow frequency signal of current frame and the narrow frequency signal of historical frame, wherein the first type of signal is a fricative signal and the second type of signal is a non-fricative signal;

when the current frame of speech/audio signal is a first type of signal, limiting the spectrum tilt parameter to less than or equal to a first predetermined value to obtain a spectrum tilt parameter limit value;

when the current frame of speech/audio signal is a second type of signal, limiting the spectrum tilt parameter to a value in a first range to obtain a spectrum tilt parameter limit value; and using the spectrum tilt parameter limit value as the time-domain global gain parameter of the high frequency signal.

With reference to the second possible implementation manner of the first aspect, in a third possible implementation manner, wherein the step of limiting the spectrum tilt parameter to less than or equal to a first predetermined value to obtain a spectrum tilt parameter limit value comprises:

when a value of the spectrum tilt parameter is less than or equal to the first predetermined value, the value of the spectrum tilt parameter is kept as the spectrum tilt parameter limit value;

when a value of the spectrum tilt parameter is greater than the first predetermined value, the first predetermined value is used as the spectrum tilt parameter limit value.

With reference to the second possible implementation manner of the first aspect, in a fourth possible implementation manner, wherein the step of limiting the spectrum tilt parameter to a value in a first range to obtain a spectrum tilt parameter limit value comprises:

when a value of the spectrum tilt parameter belongs to the first range, the value of the spectrum tilt parameter is kept as the spectrum tilt parameter limit value;

when a value of the spectrum tilt parameter is greater than an upper limit of the first range, the upper limit of the first range is used as the spectrum tilt parameter limit value;

when a value of the spectrum tilt parameter is less than a lower limit of the first range, the lower limit of the first range is used as the spectrum tilt parameter limit value.

With reference to the second possible implementation manner of the first aspect, in a fifth possible implementation manner, wherein the first predetermined value is 8 and the first range is [0.5, 1].

In a sixth possible implementation manner of the second aspect, wherein the obtaining an initial high frequency signal corresponding to a current frame of speech/audio signal comprises:

predicting a high frequency excitation signal according to the current frame of speech/audio signal;

predicting an LPC coefficient of the high frequency signal; and synthesizing the high frequency excitation signal and the LPC coefficient of the high frequency signal, to obtain the predicted high frequency signal.

According to a third aspect of the present invention, a speech/audio signal processing apparatus includes:

a predicting unit, configured to: when a speech/audio signal switches from a wide frequency signal to a narrow frequency signal, obtain an initial high frequency signal corresponding to a current frame of speech/audio signal;

a parameter obtaining unit, configured to obtain a time-domain global gain parameter of the high frequency signal according to a spectrum tilt parameter of the current frame of speech/audio signal and a correlation between a narrow frequency signal of current frame and a narrow frequency signal of historical frame;

a correcting unit, configured to correct the initial high frequency signal by using the predicted global gain parameter, to obtain a corrected high frequency time-domain signal; and a synthesizing unit, configured to synthesize a narrow frequency time-domain signal of current frame and the corrected high frequency time-domain signal and output the synthesized signal.

In a first possible implementation manner of the third aspect, wherein the parameter obtaining unit comprises:

a classifying unit, configured to classify the current frame of speech/audio signal as a first type of signal or a second type of signal according to the spectrum tilt parameter of the current frame of speech/audio signal and the correlation between the current frame of speech/audio signal and the narrow frequency signal of historical frame;

a first limiting unit, configured to: when the current frame of speech/audio signal is a first type of signal, limit the spectrum tilt parameter to less than or equal to a first predetermined value, to obtain a spectrum tilt parameter limit value, and use the spectrum tilt parameter limit value as the time-domain global gain parameter of the high frequency signal; and a second limiting unit, configured to: when the current frame of speech/audio signal is a second type of signal, limit the spectrum tilt parameter to a value in a first range, to obtain a spectrum tilt parameter limit value, and use the spectrum tilt parameter limit value as the time-domain global gain parameter of the high frequency signal.

With reference to the first possible implementation manner of the third aspect, in a second possible implementation manner, wherein the first type of signal is a fricative signal, and the second type of signal is a non-fricative signal; when the spectrum tilt parameter tilt>5 and a correlation parameter cor is less than a given value, the narrow frequency signal is classified as a fricative, the rest being non-fricatives; the first predetermined value is 8; and the first preset range is [0.5, 1].

With reference to anyone of the third aspect, the first possible implementation manner of the third aspect and the second possible implementation manner of the third aspect, in a third possible implementation manner, further comprising:

a weighting processing unit, configured to perform weighting processing on an energy ratio and the time-domain global gain parameter, and use an obtained weighted value as a predicted global gain parameter, wherein the energy ratio is a ratio between energy of a historical frame of high frequency time-domain signal and energy of a current frame of initial high frequency signal, wherein the correcting unit is configured to correct the initial high frequency signal by using the predicted global gain parameter, to obtain the corrected high frequency time-domain signal.

With reference to anyone of the third aspect, the first possible implementation manner of the third aspect and the second possible implementation manner of the third aspect, in a fourth possible implementation manner, wherein the parameter obtaining unit is further configured to obtain a time-domain envelope parameter corresponding to the initial high frequency signal; and the correcting unit is configured to correct the initial high frequency signal by using the time-domain envelope parameter and the time-domain global gain parameter.

According to a fourth aspect of the present invention, a speech/audio signal processing apparatus includes:

an acquiring unit, configured to: when a speech/audio signal switches bandwidth, obtain an initial high frequency signal corresponding to a current frame of speech/audio signal;

a parameter obtaining unit, configured to obtain a time-domain global gain parameter corresponding to the initial high frequency signal;

a weighting processing unit, configured to perform weighting processing on an energy ratio and the time-domain global gain parameter, and use an obtained weighted value as a predicted global gain parameter, where the energy ratio is a ratio between energy of a historical frame of high frequency time-domain signal and energy of a current frame of initial high frequency signal;

a correcting unit, configured to correct the initial high frequency signal by using the predicted global gain parameter, to obtain a corrected high frequency time-domain signal; and a synthesizing unit, configured to synthesize a narrow frequency time-domain signal of current frame and the corrected high frequency time-domain signal output the synthesized signal.

In a first possible implementation manner of the fourth aspect, wherein the bandwidth switching is switching from a wide frequency signal to a narrow frequency signal, and the parameter obtaining unit comprises:

a global gain parameter obtaining unit, configured to obtain the time-domain global gain parameter of the high frequency signal according to a spectrum tilt parameter of the current frame of speech/audio signal and a correlation between a current frame of speech/audio signal and a narrow frequency signal of historical frame.

With reference to the first possible implementation manner of the fourth aspect, in a second possible implementation manner, wherein the global gain parameter obtaining unit comprises:

a classifying unit, configured to classify the current frame of speech/audio signal as a first type of signal or a second type of signal according to the spectrum tilt parameter of the current frame of speech/audio signal and the correlation between the current frame of speech/audio signal and the narrow frequency signal of historical frame;

a first limiting unit, configured to: when the current frame of speech/audio signal is a first type of signal, limit the spectrum tilt parameter to less than or equal to a first predetermined value, to obtain a spectrum tilt parameter limit value, and use the spectrum tilt parameter limit value as the time-domain global gain parameter of the high frequency signal; and a second limiting unit, configured to: when the current frame of speech/audio signal is a second type of signal, limit the spectrum tilt parameter to a value in a first range, to obtain a spectrum tilt parameter limit value, and use the spectrum tilt parameter limit value as the time-domain global gain parameter of the high frequency signal.

With reference to the second possible implementation manner of the fourth aspect, in a third possible implementation manner, wherein the first type of signal is a fricative signal, and the second type of signal is a non-fricative signal; when the spectrum tilt parameter tilt>5 and a correlation parameter cor is less than a given value, the narrow frequency signal is classified as a fricative, the rest being non-fricatives; the first predetermined value is 8; and the first preset range is [0.5, 1].

With reference to anyone of the fourth aspect, the first possible implementation manner of the fourth aspect and the second possible implementation manner of the fourth aspect, in a fourth possible implementation manner, wherein the bandwidth switching is switching from a wide frequency signal to a narrow frequency signal, and the apparatus further comprises:

a time-domain envelope obtaining unit, configured to use a series of preset values as a high frequency time-domain envelope parameter of the current frame of speech/audio signal; and the correcting unit is configured to correct the initial high frequency signal by using the time-domain envelope parameter and the predicted global gain parameter, to obtain the corrected high frequency time-domain signal.

With reference to anyone of the fourth aspect, the first possible implementation manner of the fourth aspect and the second possible implementation manner of the fourth aspect, in a fifth possible implementation manner, wherein the acquiring unit comprises:

an excitation signal obtaining unit, configured to predict an excitation signal of the high frequency signal according to the current frame of speech/audio signal;

an LPC coefficient obtaining unit, configured to predict an LPC coefficient of the high frequency signal; and a synthesizing unit, configured to synthesize the excitation signal of the high frequency signal and the LPC coefficient of the high frequency signal, to obtain the predicted high frequency signal.

With reference to anyone of the fourth aspect, the first possible implementation manner of the fourth aspect and the second possible implementation manner of the fourth aspect, in a sixth possible implementation manner, wherein the bandwidth switching is switching from a narrow frequency signal to a wide frequency signal, and the apparatus further comprises:

a weighting factor setting unit, configured to: when narrowband signals of the current frame of speech/audio signal and a previous frame of speech/audio signal have a predetermined correlation, use a value obtained by attenuating, according to a step size, a weighting factor alfa of an energy ratio corresponding to the previous frame of speech/audio signal as a weighting factor of an energy ratio corresponding to the current audio frame, wherein the attenuation is performed frame by frame until alfa is 0.

In the embodiments of the present invention, during switching between a wide frequency band and a narrow frequency band, a high frequency signal is corrected, so as to implement a smooth transition of the high frequency signal between the wide frequency band and the narrow frequency band, thereby effectively eliminating aural discomfort caused by the switching between the wide frequency band and the narrow frequency band; in addition, because a bandwidth switching algorithm and a coding/decoding algorithm of the high frequency signal before switching are in a same signal domain, it not only ensures that no extra delay is added and the algorithm is simple, it also ensures performance of an output signal.

BRIEF DESCRIPTION OF DRAWINGS

To describe the technical solutions in the embodiments of the present invention, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

Figure 1:
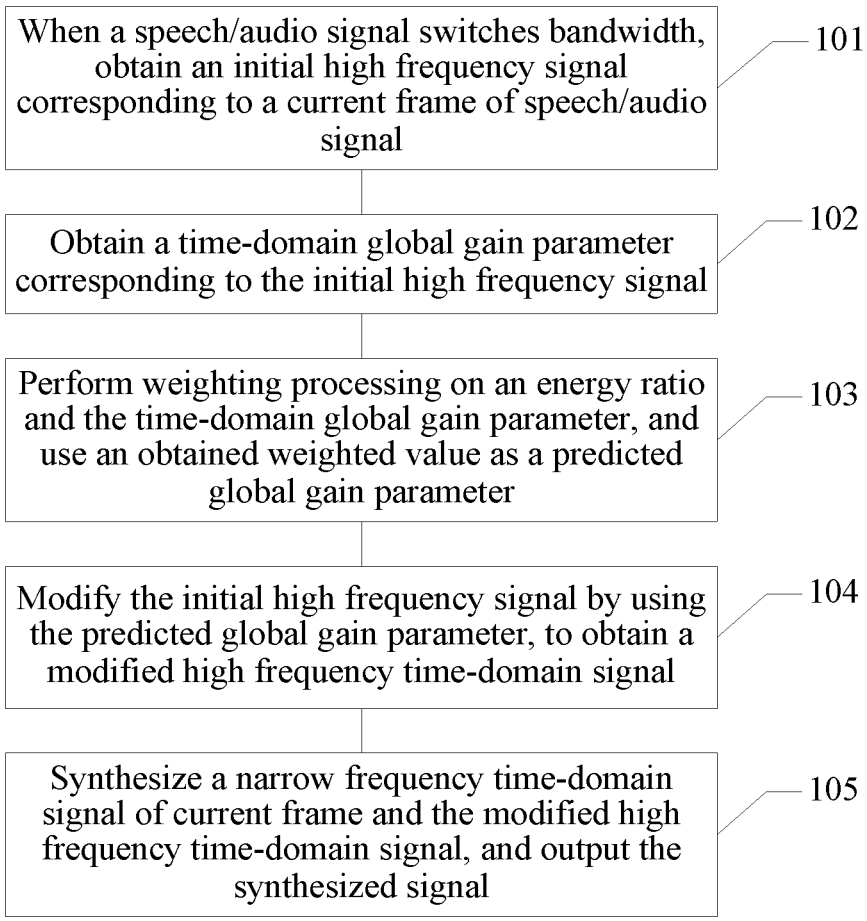
FIG. 1 is a schematic flowchart of an embodiment of a speech/audio signal processing method according to the present invention.

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

In the field of digital signal processing, audio codecs and video codecs are widely applied in various electronic devices, for example, a mobile phone, a wireless apparatus, a personal data assistant (PDA), a handheld or portable computer, a GPS receiver/navigator, a camera, an audio/video player, a video camera, a video recorder, and a monitoring device. Usually, this type of electronic device includes an audio coder or an audio decoder, where the audio coder or decoder may be directly implemented by a digital circuit or a chip, for example, a DSP (digital signal processor), or be implemented by a software code driving a processor to execute a process in the software code.

In the prior art, because bandwidths of speech/audio signals transmitted in a network are different, in a process of transmitting speech/audio signals, bandwidths of the speech/audio signals frequently change, and phenomena of switching from a narrow frequency speech/audio signal to a wide frequency speech/audio signal and switching from a wide frequency speech/audio signal to a narrow frequency speech/audio signal exist. Such a process of switching a speech/audio signal between high and low frequency bands is referred to as bandwidth switching. The bandwidth switching includes switching from a narrow frequency signal to a wide frequency signal and switching from a wide frequency signal to a narrow frequency signal. The narrow frequency signal mentioned in the present invention is a speech signal that only has a low frequency component and a high frequency component is empty after up-sampling and low-pass filtering, while the wide frequency speech/audio signal has both a low frequency signal component and a high frequency signal component. The narrow frequency signal and the wide frequency signal are relative. For example, for a narrowband signal, a wideband signal is a wide frequency signal; and for a wideband signal, a super-wideband signal is a wide frequency signal. Generally, a narrowband signal is a speech/audio signal of which a sampling rate is 8 kHz; a wideband signal is a speech/audio signal of which a sampling rate is 16 kHz; and a super-wideband signal is a speech/audio signal of which a sampling rate is 32 kHz.

When a coding/decoding algorithm of a high frequency signal before switching is selected between time-domain and frequency-domain coding/decoding algorithms according to different signal types, or when a coding algorithm of the high frequency signal before switching is a time-domain coding algorithm, in order to ensure continuity of output signals during the switching, a switching algorithm is kept in a signal domain for processing, where the signal domain is the same as that of the high frequency coding/decoding algorithm before the switching. That is, when the time-domain coding/decoding algorithm is used for the high frequency signal before the switching, a time-domain switching algorithm is used as a switching algorithm to be used; when the frequency-domain coding/decoding algorithm is used for the high frequency signal before the switching, a frequency-domain switching algorithm is used as a switching algorithm to be used. In the prior art, when a time-domain frequency band extension algorithm is used before switching, a similar time-domain switching technology is not used after the switching.

In speech/audio coding, processing is generally performed by using a frame as a unit. A current input audio frame that needs to be processed is a current frame of speech/audio signal. The current frame of speech/audio signal includes a narrow frequency signal and a high frequency signal, that is, a narrow frequency signal of current frame and a high frequency signal of current frame. Any frame of speech/audio signal before the high frequency signal of current frame is a historical frame of speech/audio signal, which also includes a narrow frequency signal of historical frame and a high frequency signal of historical frame. A frame of speech/audio signal previous to the current frame of speech/audio signal is a previous frame of speech/audio signal.

Referring to FIG. 1, an embodiment of a speech/audio signal processing method of the present invention includes:

S101: When a speech/audio signal switches bandwidth, obtain an initial high frequency signal corresponding to a current frame of speech/audio signal.

The current frame of speech/audio signal includes a narrow frequency signal of current frame and a high frequency time-domain signal of current frame. Bandwidth switching includes switching from a narrow frequency signal to a wide frequency signal and switching from a wide frequency signal to a narrow frequency signal. In the case of switching from a narrow frequency signal to a wide frequency signal, the current frame of speech/audio signal is the current frame of wide frequency signal, including a narrow frequency signal and a high frequency signal, and the initial high frequency signal of the current frame of speech/audio signal is a real signal and may be directly obtained from the current frame of speech/audio signal. In the case of switching from a wide frequency signal to a narrow frequency signal, the current frame of speech/audio signal is the narrow frequency signal of current frame of which a high frequency time-domain signal of current frame is empty, the initial high frequency signal of the current frame of speech/audio signal is a predicted signal, and a high frequency signal corresponding to the narrow frequency signal of current frame needs to be predicted and used as the initial high frequency signal.

S102: Obtain a time-domain global gain parameter corresponding to the initial high frequency signal.

In the case of switching from a narrow frequency signal to a wide frequency signal, the time-domain global gain parameter of the high frequency signal may be obtained by decoding. In the case of switching from a wide frequency signal to a narrow frequency signal, the time-domain global gain parameter of the high frequency signal may be obtained according to the current frame of signal: the time-domain global gain parameter of the high frequency signal is obtained according to a spectrum tilt parameter of the narrow frequency signal and a correlation between a narrow frequency signal of current frame and a narrow frequency signal of historical frame.

S103: Perform weighting processing on an energy ratio and the time-domain global gain parameter, and use an obtained weighted value as a predicted global gain parameter, where the energy ratio is a ratio between energy of a high frequency time-domain signal of a historical frame of speech/audio signal and energy of the initial high frequency signal of the current frame of speech/audio signal.

A historical frame of final output speech/audio signal is used as the historical frame of speech/audio signal is used, and the initial high frequency signal is used as the current frame of speech/audio signal. The energy ratio Ratio=Esyn(−1)/Esyn_tmp, where Esyn(−1) represents the energy of the output high frequency time-domain signal syn of the historical frame, and Esyn_tmp represents the energy of the initial high frequency time-domain signal syn corresponding to the current frame.

The predicted global gain parameter gain=alfa*Ratio+beta*gain', where gain' is the time-domain global gain parameter, alfa+beta=1, and values of alfa and beta are different according to different signal types.

S104: Correct the initial high frequency signal by using the predicted global gain parameter, to obtain a corrected high frequency time-domain signal.

The correction refers to that the signal is multiplied, that is, the initial high frequency signal is multiplied by the predicted global gain parameter. In another embodiment, in step S102, a time-domain envelope parameter and the time-domain global gain parameter that are corresponding to the initial high frequency signal are obtained; therefore, in step S104, the initial high frequency signal is corrected by using the time-domain envelope parameter and the predicted global gain parameter, to obtain the corrected high frequency time-domain signal; that is, the predicted high frequency signal is multiplied by the time-domain envelope parameter and the predicted time-domain global gain parameter, to obtain the corrected high frequency time-domain signal.

In the case of switching from a narrow frequency signal to a wide frequency signal, the time-domain envelope parameter of the high frequency signal may be obtained by decoding. In the case of switching from a wide frequency signal to a narrow frequency signal, the time-domain envelope parameter of the high frequency signal may be obtained according to the current frame of signal: a series of predetermined values or a high frequency time-domain envelope parameter of the historical frame may be used as the high frequency time-domain envelope parameter of the current frame of speech/audio signal.

S105: Synthesize a narrow frequency time-domain signal of current frame and the corrected high frequency time-domain signal and output the synthesized signal.

In the foregoing embodiment, during switching between a wide frequency band and a narrow frequency band, a high frequency signal is corrected, so as to implement a smooth transition of the high frequency signal between the wide frequency band and the narrow frequency band, thereby effectively eliminating aural discomfort caused by the switching between the wide frequency band and the narrow frequency band; in addition, because a bandwidth switching algorithm and a coding/decoding algorithm of the high frequency signal before switching are in a same signal domain, it not only ensures that no extra delay is added and the algorithm is simple, it also ensures performance of an output signal.

Figure 2:
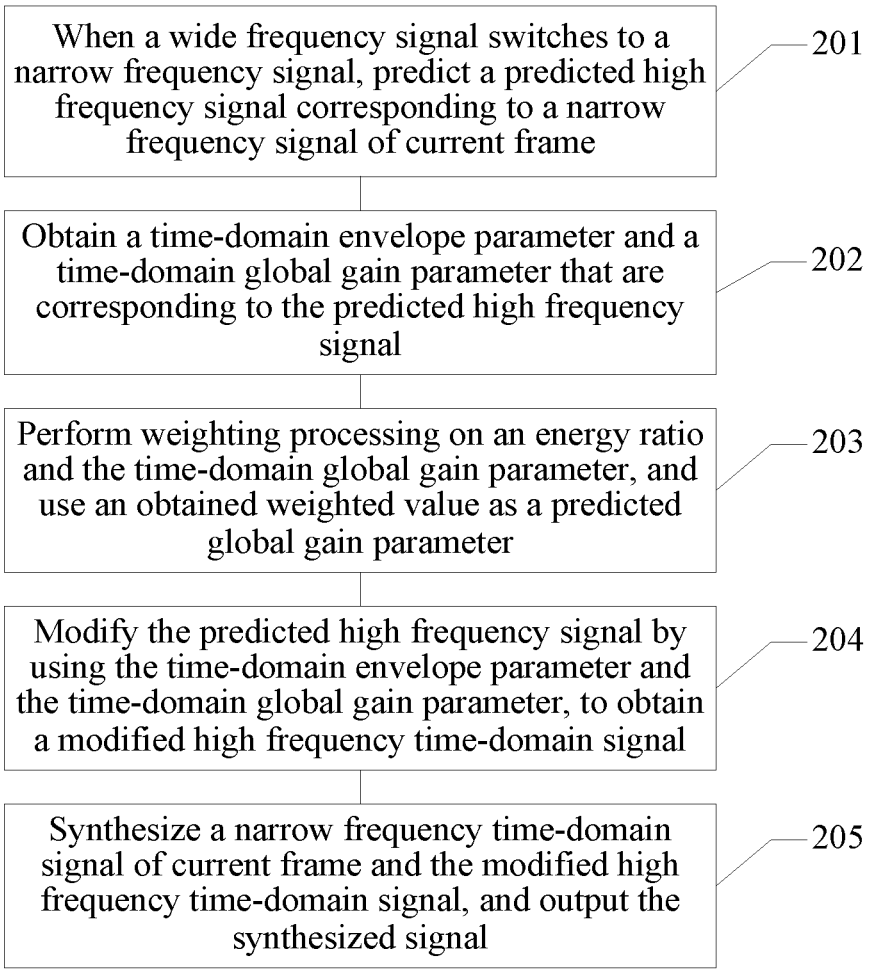
FIG. 2 is a schematic flowchart of another embodiment of a speech/audio signal processing method according to the present invention.

Referring to FIG. 2, another embodiment of a speech/audio signal processing method of the present invention includes:

S201: When a wide frequency signal switches to a narrow frequency signal, predict a predicted high frequency signal corresponding to a narrow frequency signal of current frame.

When a wide frequency signal switches to a narrow frequency signal, a previous frame is the wide frequency signal, and a current frame is the narrow frequency signal. The step of predicting a predicted high frequency signal corresponding to a narrow frequency signal of current frame includes: predicting an excitation signal of the high frequency signal of the current frame of speech/audio signal according to the narrow frequency signal of current frame; predicting an LPC (Linear Predictive Coding, linear predictive coding) coefficient of the high frequency signal of the current frame of speech/audio signal; and synthesizing the predicted high frequency excitation signal and the LPC coefficient, to obtain the predicted high frequency signal syn_tmp.

In an embodiment, parameters such as a pitch period, an algebraic codebook, and a gain may be extracted from the narrow frequency signal, and the high frequency excitation signal is predicted by resampling and filtering.

In another embodiment, operations such as up-sampling, low-pass, and obtaining of an absolute value or a square may be performed on the narrow frequency time-domain signal or a narrow frequency time-domain excitation signal, so as to predict the high frequency excitation signal.

To predicate the LPC coefficient of the high frequency signal, a high frequency LPC coefficient of a historical frame or a series of preset values may be used as the LPC coefficient of the current frame; or different prediction manners may be used for different signal types.

S202: Obtain a time-domain envelope parameter and a time-domain global gain parameter that are corresponding to the predicted high frequency signal.

A series of predetermined values may be used as the high frequency time-domain envelope parameter of the current frame. Narrowband signals may be generally classified into several types, a series of values may be preset for each type, and a group of preset time-domain envelope parameters may be selected according to types of current frame of narrowband signals; or a group of time-domain envelope values may be set, for example, when the number of time-domain envelops is M, the preset values may be M 0.3536 s. In this embodiment, the obtaining of a time-domain envelope parameter is an optional but not a necessary step.

The time-domain global gain parameter of the high frequency signal is obtained according to a spectrum tilt parameter of the narrow frequency signal and a correlation between a narrow frequency signal of current frame and a narrow frequency signal of historical frame, which includes the following steps in an embodiment:

S2021: Classify the current frame of speech/audio signal as a first type of signal or a second type of signal according to the spectrum tilt parameter of the current frame of speech/audio signal and the correlation between the narrow frequency signal of current frame and the narrow frequency signal of historical frame, where in an embodiment, the first type of signal is a fricative signal, and the second type of signal is a non-fricative signal; and when the spectrum tilt parameter tilt>5 and a correlation parameter cor is less than a given value, classify the narrow frequency signal as a fricative, and the rest as non-fricatives.

The parameter cor showing the correlation between the narrow frequency signal of current frame and the narrow frequency signal of historical frame may be determined according to an energy magnitude relationship between signals of a same frequency band, or may be determined according to an energy relationship between several same frequency bands, or may be calculated according to a formula showing a self-correlation or a cross-correlation between time-domain signals or showing a self-correlation or a cross-correlation between time-domain excitation signals.

S2022: When the current frame of speech/audio signal is a first type of signal, limit the spectrum tilt parameter to less than or equal to a first predetermined value, to obtain a spectrum tilt parameter limit value, and use the spectrum tilt parameter limit value as the time-domain global gain parameter of the high frequency signal. That is, when the spectrum tilt parameter of the current frame of speech/audio signal is less than or equal to the first predetermined value, an original value of the spectrum tilt parameter is kept as the spectrum tilt parameter limit value; when spectrum tilt parameter of the current frame of speech/audio signal is greater than the first predetermined value, the first predetermined value is used as the spectrum tilt parameter limit value.

The time-domain global gain parameter gain' is obtained according to the following formula:

$$\text{gain}' = \begin{cases} \text{tilt}, & \text{tilt} \le \partial 1 \\ \partial 1, & \text{tilt} > \partial 1 \end{cases},$$

where tilt is the spectrum tilt parameter, and ∂1 is the first predetermined value.

S2023: When the current frame of speech/audio signal is a second type of signal, limit the spectrum tilt parameter to a value in a first range, to obtain a spectrum tilt parameter limit value, and use the spectrum tilt parameter limit value as the time-domain global gain parameter of the high frequency signal. That is, when the spectrum tilt parameter of the current frame of speech/audio signal belongs to the first range, an original value of the spectrum tilt parameter is kept as the spectrum tilt parameter limit value; when the spectrum tilt parameter of the current frame of speech/audio signal is greater than an upper limit of the first range, the upper limit of the first range is used as the spectrum tilt parameter limit value; when the spectrum tilt parameter of the current frame of speech/audio signal is less than a lower limit of the first range, the lower limit of the first range is used as the spectrum tilt parameter limit value.

The time-domain global gain parameter gain' is obtained according to the following formula:

$$\text{gain}' = \begin{cases} \text{tilt}, \text{tilt} \in [a, b] \\ a, \text{tilt} < a \\ b, \text{tilt} > b \end{cases},$$

where tilt is the spectrum tilt parameter, and [c, b] is the first range.

In an embodiment, a spectrum tilt parameter tilt of a narrow frequency signal and a parameter cor showing a correlation between a narrow frequency signal of current frame and a narrow frequency signal of historical frame are obtained; current frame of signals are classified into two types, fricative and non-fricative, according to tilt and cor; when the spectrum tilt parameter tilt>5 and the correlation parameter cor is less than a given value, the narrow frequency signal is classified as a fricative, the rest being non-fricatives; tilt is limited within a value range of 0.5<=tilt<=1.0 and is used as a time-domain global gain parameter of a non-fricative, and tilt is limited to a value range of tilt<=8.0 and is used as a time-domain global gain parameter of a fricative. For a fricative, a spectrum tilt parameter may be any value greater than 5, and for a non-fricative, a spectrum tilt parameter may be any value less than or equal to 5, or may be greater than 5. In order to ensure that a spectrum tilt parameter tilt can be used as an estimated time-domain global gain parameter, tilt is limited within a value range and then used as a time-domain global gain parameter. That is, when tilt>8, it is determined that tilt=8 is used as a time-domain global gain parameter of a fricative; when tilt<0.5, it is determined that tilt=0.5, or when tilt>1.0, it is determined that tilt=1.0, and 0.5 or 1.0 is used as a time-domain global gain parameter of a non-fricative.

S203: Perform weighting processing on an energy ratio and the time-domain global gain parameter, and use an obtained weighted value as a predicted global gain parameter, where the energy ratio is a ratio between energy of a high frequency time-domain signal of a historical frame of speech/audio signal and energy of the initial high frequency signal of the current frame of speech/audio signal.

Calculation is performed on the energy ratio Ratio=Esyn(−1)/Esyn_tmp, and the weighted value of tilt and Ratio is used as the predicted global gain parameter gain of the current frame, that is, gain=alfa*Ratio+beta*gain', where gain' is the time-domain global gain parameter, alfa+beta=1, values of alfa and beta are different according to different signal types, Esyn(−1) represents the energy of the finally output high frequency time-domain signal syn of the historical frame, and Esyn_tmp represents the energy of the predicted high frequency time-domain signal syn of the current frame.

S204: Correct the predicted high frequency signal by using the time-domain envelope parameter and the predicted global gain parameter, to obtain a corrected high frequency time-domain signal.

The predicted high frequency signal is multiplied by the time-domain envelope parameter and the predicted time-domain global gain parameter, to obtain the high frequency time-domain signal.

In this embodiment, the time-domain envelope parameter is optional. When only the time-domain global gain parameter is included, the predicted high frequency signal may be corrected by using the predicted global gain parameter, to obtain the corrected high frequency time-domain signal. That is, the predicted high frequency signal is multiplied by the predicted global gain parameter, to obtain the corrected high frequency time-domain signal.

S205: Synthesize the narrow frequency time-domain signal of current frame and the corrected high frequency time-domain signal and output the synthesized signal.

The energy Esyn of the high frequency time-domain signal syn is used to predict a time-domain global gain parameter of a next frame. That is, a value of Esyn is assigned to Esyn(−1).

In the foregoing embodiment, a high frequency band of a narrow frequency signal following a wide frequency signal is corrected, so as to implement a smooth transition of the high frequency part between a wide frequency band and a narrow frequency band, thereby effectively eliminating aural discomfort caused by the switching between the wide frequency band and the narrow frequency band; in addition, because corresponding processing is performed on the frame during the switching, a problem that occurs during parameter and status updating is indirectly eliminated. By keeping, a bandwidth switching algorithm and a coding/decoding algorithm of the high frequency signal before the switching, in a same signal domain, it not only ensures that no extra delay is added and the algorithm is simple, it also ensures performance of an output signal.

Figure 3:
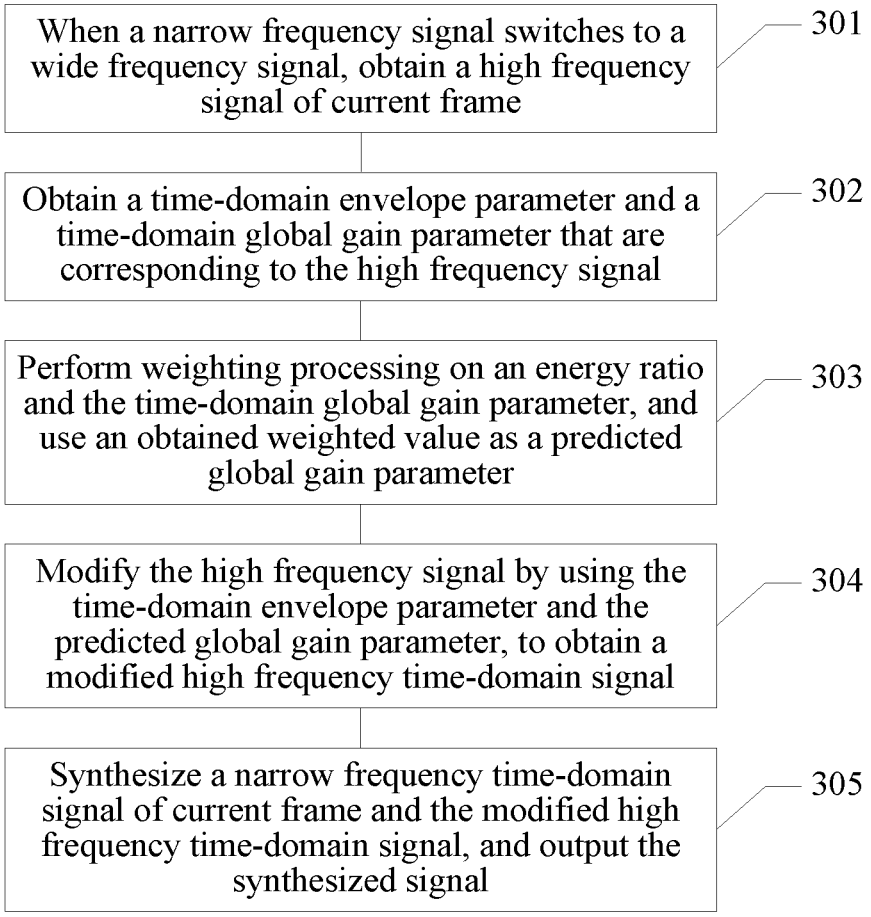
FIG. 3 is a schematic flowchart of another embodiment of a speech/audio signal processing method according to the present invention.

Referring to FIG. 3, another embodiment of a speech/audio signal processing method of the present invention includes:

S301: When a narrow frequency signal switches to a wide frequency signal, obtain a high frequency signal of current frame.

When a narrow frequency signal switches to a wide frequency signal, a previous frame is a narrow frequency signal, and a current frame is a wide frequency signal.

S302: Obtain a time-domain envelope parameter and a time-domain global gain parameter that are corresponding to the high frequency signal.

The time-domain envelope parameter and the time-domain global gain parameter may be directly obtained from the high frequency signal of current frame. The obtaining of a time-domain envelope parameter is an optional step.

S303: Perform weighting processing on an energy ratio and the time-domain global gain parameter, and use an obtained weighted value as a predicted global gain parameter, where the energy ratio is a ratio between energy of a high frequency time-domain signal of a historical frame of speech/audio signal and energy of an initial high frequency signal of a current frame of speech/audio signal.

Because the current frame is a wide frequency signal, parameters of the high frequency signal may all be obtained by decoding. In order to ensure a smooth transition during switching, the time-domain global gain parameter is smoothed in the following manner:

Calculation is performed on the energy ratio Ratio=Esyn(−1)/Esyn_tmp, where Esyn(−1) represents energy of a finally output high frequency time-domain signal syn of a historical frame, and Esyn_tmp represents energy of a high frequency time-domain signal syn of the current frame.

The weighted value of the time-domain global gain parameter gain and Ratio that are obtained by decoding is used as the predicted global gain parameter gain of the current frame, that is, gain=alfa*Ratio+beta*gain', where gain' is the time-domain global gain parameter, alfa+beta=1, and values of alfa and beta are different according to different signal types.

When narrowband signals of the current audio frame and a previous frame of speech/audio signal have a predetermined correlation, a value obtained by attenuating, according to a certain step size, a weighting factor alfa of the energy ratio corresponding to the previous frame of speech/audio signal is used as a weighting factor of the energy ratio corresponding to the current audio frame, where the attenuation is performed frame by frame until alfa is 0.

When narrow frequency signals of consecutive frames are of a same signal type, or a correlation between narrow frequency signals of consecutive frames satisfies a certain condition, that is, the consecutive frames have a certain correlation or signal types of the consecutive frames are similar, alfa is attenuated frame by frame according to a certain step size until alfa is attenuated to 0; when the narrow frequency signals of the consecutive frames have no correlation, alfa is directly attenuated to 0, that is, a current decoding result is maintained without performing weighting or correcting.

S304: Correct the high frequency signal by using the time-domain envelope parameter and the predicted global gain parameter, to obtain a corrected high frequency time-domain signal.

The correction refers to that the high frequency signal is multiplied by the time-domain envelope parameter and the predicted time-domain global gain parameter, to obtain the corrected high frequency time-domain signal.

In this embodiment, the time-domain envelope parameter is optional. When only the time-domain global gain parameter is included, the high frequency signal may be corrected by using the predicted global gain parameter, to obtain the corrected high frequency time-domain signal. That is, the high frequency signal is multiplied by the predicted global gain parameter, to obtain the corrected high frequency time-domain signal.

S305: Synthesize a narrow frequency time-domain signal of current frame and the corrected high frequency time-domain signal and output the synthesized signal.

In the foregoing embodiment, a high frequency band of a wide frequency signal following a narrow frequency signal is corrected, so as to implement a smooth transition of the high frequency part between a wide frequency band and a narrow frequency band, thereby effectively eliminating aural discomfort caused by the switching between the wide frequency band and the narrow frequency band; in addition, because corresponding processing is performed on the frame of during the switching, a problem that occurs during parameter and status updating is indirectly eliminated. By keeping, a bandwidth switching algorithm and a coding/decoding algorithm of the high frequency signal before the switching, in a same signal domain, it not only ensures that no extra delay is added and the algorithm is simple, it also ensures performance of an output signal.

Figure 4:
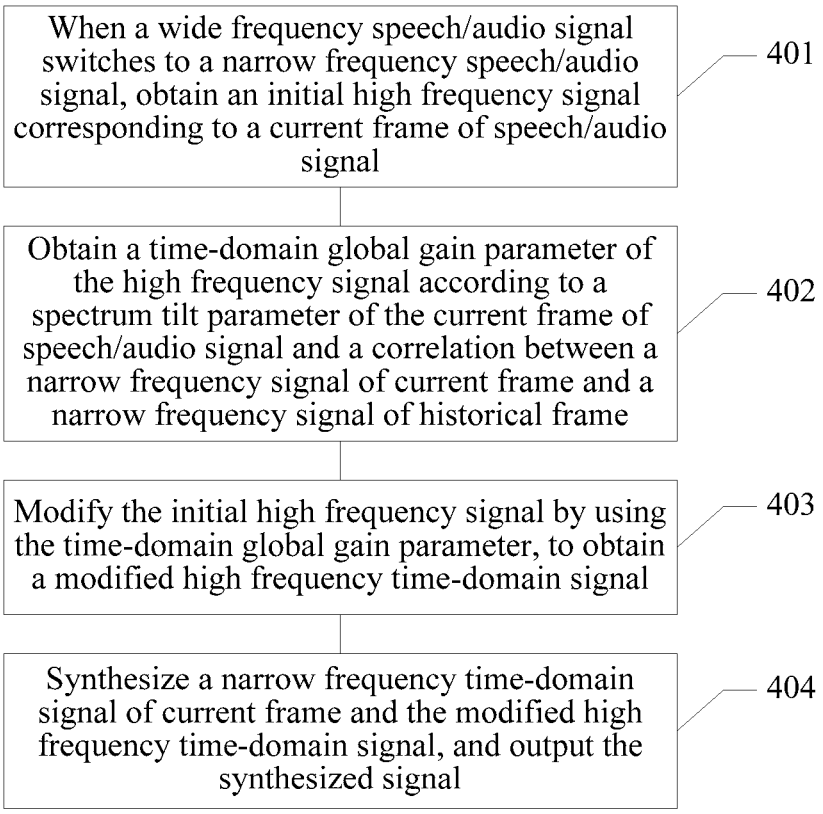
FIG. 4 is a schematic flowchart of another embodiment of a speech/audio signal processing method according to the present invention.

Referring to FIG. 4, another embodiment of a speech/audio signal processing method of the present invention includes:

S401: When a speech/audio signal switches from a wide frequency signal to a narrow frequency signal, obtain an initial high frequency signal corresponding to a current frame of speech/audio signal.

When a wide frequency signal switches to a narrow frequency signal, a previous frame is the wide frequency signal, and a current frame is the narrow frequency signal. The step of predicting an initial high frequency signal corresponding to a narrow frequency signal of current frame includes: predicting an excitation signal of the high frequency signal of the current frame of speech/audio signal according to the narrow frequency signal of current frame; predicting an LPC coefficient of the high frequency signal of the current frame of speech/audio signal; and synthesizing the predicted high frequency excitation signal and the LPC coefficient, to obtain the predicted high frequency signal syn_tmp.

In an embodiment, parameters such as a pitch period, an algebraic codebook, and a gain may be extracted from the narrow frequency signal, and the high frequency excitation signal is predicted by resampling and filtering.

In another embodiment, operations such as up-sampling, low-pass, and obtaining of an absolute value or a square may be performed on the narrow frequency time-domain signal or a narrow frequency time-domain excitation signal, so as to predict the high frequency excitation signal.

To predicate the LPC coefficient of the high frequency signal, a high frequency LPC coefficient of a historical frame or a series of preset values may be used as the LPC coefficient of the current frame; or different prediction manners may be used for different signal types.

S402: Obtain a time-domain global gain parameter of the high frequency signal according to a spectrum tilt parameter of the current frame of speech/audio signal and a correlation between a narrow frequency signal of current frame and a narrow frequency signal of historical frame.

In an embodiment, the following steps are included:

S2021: Classify the current frame of speech/audio signal as a first type of signal or a second type of signal according to the spectrum tilt parameter of the current frame of speech/audio signal and the correlation between the narrow frequency signal of current frame and the narrow frequency signal of historical frame, where in an embodiment, the first type of signal is a fricative signal, and the second type of signal is a non-fricative signal.

In an embodiment, when the spectrum tilt parameter tilt>5, and a correlation parameter cor is less than a given value, the narrow frequency signal is classified as a fricative, the rest being non-fricatives. The parameter cor showing the correlation between the narrow frequency signal of current frame and the narrow frequency signal of historical frame may be determined according to an energy magnitude relationship between signals of a same frequency band, or may be determined according to an energy relationship between several same frequency bands, or may be calculated according to a formula showing a self-correlation or a cross-correlation between time-domain signals or showing a self-correlation or a cross-correlation between time-domain excitation signals.

S2022: When the current frame of speech/audio signal is a first type of signal, limit the spectrum tilt parameter to less than or equal to a first predetermined value, to obtain a spectrum tilt parameter limit value, and use the spectrum tilt parameter limit value as the time-domain global gain parameter of the high frequency signal. That is, when the spectrum tilt parameter of the current frame of speech/audio signal is less than or equal to the first predetermined value, an original value of the spectrum tilt parameter is kept as the spectrum tilt parameter limit value; when spectrum tilt parameter of the current frame of speech/audio signal is greater than the first predetermined value, the first predetermined value is used as the spectrum tilt parameter limit value.

When the current frame of speech/audio signal is a fricative signal, the time-domain global gain parameter gain' is obtained according to the following formula:

$$\text{gain}' = \begin{cases} \text{tilt}, & \text{tilt} \le \partial 1 \\ \partial 1, & \text{tilt} > \partial 1 \end{cases},$$

where tilt is the spectrum tilt parameter, and ∂1 is the first predetermined value.

S2023: When the current frame of speech/audio signal is a second type of signal, limit the spectrum tilt parameter to a value in a first range, to obtain a spectrum tilt parameter limit value, and use the spectrum tilt parameter limit value as the time-domain global gain parameter of the high frequency signal. That is, when the spectrum tilt parameter of the current frame of speech/audio signal belongs to the first range, an original value of the spectrum tilt parameter is kept as the spectrum tilt parameter limit value; when the spectrum tilt parameter of the current frame of speech/audio signal is greater than an upper limit of the first range, the upper limit of the first range is used as the spectrum tilt parameter limit value; when the spectrum tilt parameter of the current frame of speech/audio signal is less than a lower limit of the first range, the lower limit of the first range is used as the spectrum tilt parameter limit value.

When the current frame of speech/audio signal is a non-fricative signal, the time-domain global gain parameter gain' is obtained according to the following formula:

$$\text{gain}' = \begin{cases} \text{tilt}, \text{tilt} \in [a, b] \\ a, \text{tilt} < a \\ b, \text{tilt} > b \end{cases},$$

where tilt is the spectrum tilt parameter, and [c, b] is the first range.

In an embodiment, a spectrum tilt parameter tilt of a narrow frequency signal and a parameter cor showing a correlation between a narrow frequency signal of current frame and a narrow frequency signal of historical frame are obtained; current frame of signals are classified into two types, fricative and non-fricative, according to tilt and cor; when the spectrum tilt parameter tilt>5 and the correlation parameter cor is less than a given value, the narrow frequency signal is classified as a fricative, the rest being non-fricatives; tilt is limited within a value range of 0.5<=tilt<=1.0 and is used as a time-domain global gain parameter of a non-fricative, and tilt is limited to a value range of tilt<=8.0 and is used as a time-domain global gain parameter of a fricative. For a fricative, a spectrum tilt parameter may be any value greater than 5, and for a non-fricative, a spectrum tilt parameter may be any value less than or equal to 5, or may be greater than 5. In order to ensure that a spectrum tilt parameter tilt can be used as a predicted global gain parameter, tilt is limited within a value range and then used as a time-domain global gain parameter. That is, when tilt>8, it is determined that tilt=8 and 8 is used as a time-domain global gain parameter of a fricative signal; when tilt<0.5, it is determined that tilt=0.5, or when tilt>1.0, it is determined that tilt=1.0, and 0.5 or 1.0 is used as a time-domain global gain parameter of a non-fricative signal.

S403: Correct the initial high frequency signal by using the time-domain global gain parameter, to obtain a corrected high frequency time-domain signal.

In an embodiment, the initial high frequency signal is multiplied by the time-domain global gain parameter, to obtain the corrected high frequency time-domain signal.

In another embodiment, step S403 may include:

performing weighting processing on a energy ratio and the time-domain global gain parameter, and using an obtained weighted value as a predicted global gain parameter, where the energy ratio is a ratio between energy of a high frequency time-domain signal of historical frame and energy of a initial high frequency signal of current frame; and correcting the initial high frequency signal by using the predicted global gain parameter, to obtain a corrected high frequency time-domain signal; that is, the initial high frequency signal is multiplied by the predicted global gain parameter, to obtain a corrected high frequency time-domain signal.

Optionally, before step S403, the method may further include:

obtaining a time-domain envelope parameter corresponding to the initial high frequency signal, and the correcting the initial high frequency signal by using the predicted global gain parameter includes:

correcting the initial high frequency signal by using the time-domain envelope parameter and the time-domain global gain parameter.

S404: Synthesize a narrow frequency time-domain signal of current frame and the corrected high frequency time-domain signal and output the synthesized signal.

In the foregoing embodiment, when a wide frequency band switches to a narrow frequency band, a time-domain global gain parameter of a high frequency signal is obtained according to a spectrum tilt parameter and an interframe correlation. By using the narrow frequency spectrum tilt parameter, an energy relationship between a narrow frequency signal and a high frequency signal can be correctly estimated, so as to better estimate energy of the high frequency signal. By using the interframe correlation, an interframe correlation between high frequency signals can be estimated by making a good use of the correlation between narrow frequency frames. In this way, when weighting is performed to obtain a high frequency global gain, the foregoing real information can be used well, and an undesirable noise is not introduced. The high frequency signal is corrected by using the time-domain global gain parameter, so as to implement a smooth transition of the high frequency part between the wide frequency band and the narrow frequency band, thereby effectively eliminating aural discomfort caused by the switching between the wide frequency band and the narrow frequency band.

Figure 5:
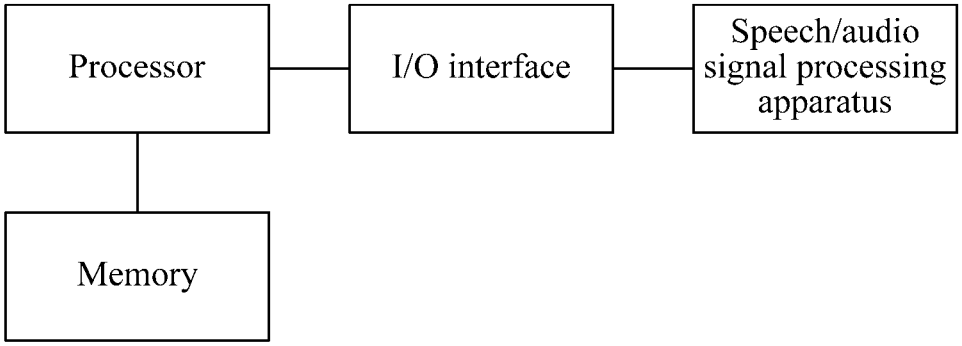
FIG. 5 is a schematic structural diagram of an embodiment of a speech/audio signal processing apparatus according to the present invention.

In association with the foregoing method embodiments, the present invention further provides a speech/audio signal processing apparatus. The apparatus may be located in a terminal device, a network device, or a test device. The speech/audio signal processing apparatus may be implemented by a hardware circuit, or may be implemented by software in combination with hardware. For example, referring to FIG. 5, a processor invokes the speech/audio signal processing apparatus, to implement speech/audio signal processing. The speech/audio signal processing apparatus may execute the methods and processes in the foregoing method embodiments.

Figure 6:
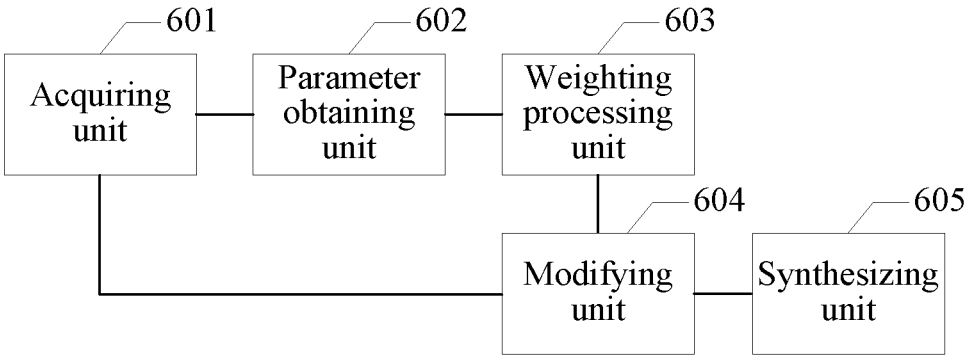
FIG. 6 is a schematic structural diagram of an embodiment of a speech/audio signal processing apparatus according to the present invention.

Referring to FIG. 6, an embodiment of a speech/audio signal processing apparatus includes:

an acquiring unit 601, configured to: when a speech/audio signal switches bandwidth, obtain an initial high frequency signal corresponding to a current frame of speech/audio signal;

a parameter obtaining unit 602, configured to obtain a time-domain global gain parameter corresponding to the initial high frequency signal;

a weighting processing unit 603, configured to perform weighting processing on an energy ratio and the time-domain global gain parameter, and use an obtained weighted value as a predicted global gain parameter, where the energy ratio is a ratio between energy of a high frequency time-domain signal of historical frame and energy of the initial high frequency signal of current frame;

a correcting unit 604, configured to correct the initial high frequency signal by using the predicted global gain parameter, to obtain a corrected high frequency time-domain signal; and a synthesizing unit 605, configured to synthesize a narrow frequency time-domain signal of current frame and the corrected high frequency time-domain signal and output the synthesized signal.

In an embodiment, the bandwidth switching is switching from a wide frequency signal to a narrow frequency signal, and the parameter obtaining unit 602 includes:

a global gain parameter obtaining unit, configured to obtain the time-domain global gain parameter of the high frequency signal according to a spectrum tilt parameter of the current frame of speech/audio signal and a correlation between a current frame of speech/audio signal and a narrow frequency signal of historical frame.

Figure 7:
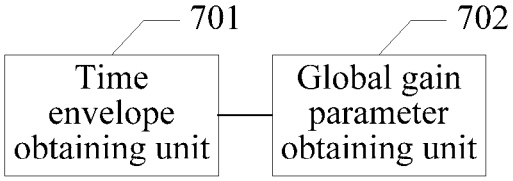
FIG. 7 is a schematic structural diagram of an embodiment of a parameter obtaining unit according to the present invention.

Referring to FIG. 7, in another embodiment, the bandwidth switching is switching from a wide frequency signal to a narrow frequency signal, and the parameter obtaining unit 602 includes:

a time-domain envelope obtaining unit 701, configured to use a series of preset values as a high frequency time-domain envelope parameter of the current frame of speech/audio signal; and a global gain parameter obtaining unit 702, configured to obtain the time-domain global gain parameter of the high frequency signal according to a spectrum tilt parameter of the current frame of speech/audio signal and a correlation between a current frame of speech/audio signal and a narrow frequency signal of historical frame.

Therefore, the correcting unit 604 is configured to correct the initial high frequency signal by using the time-domain envelope parameter and the predicted global gain parameter, to obtain the corrected high frequency time-domain signal.

Figure 8:
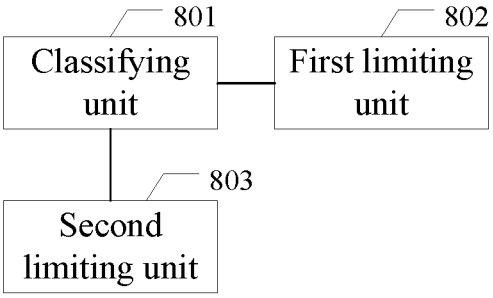
FIG. 8 is a schematic structural diagram of an embodiment of a global gain parameter obtaining unit according to the present invention.

Referring to FIG. 8, further, an embodiment of the global gain parameter obtaining unit 702 includes:

a classifying unit 801, configured to classify the current frame of speech/audio signal as a first type of signal or a second type of signal according to the spectrum tilt parameter of the current frame of speech/audio signal and the correlation between the current frame of speech/audio signal and the narrow frequency signal of historical frame;

a first limiting unit 802, configured to: when the current frame of speech/audio signal is a first type of signal, limit the spectrum tilt parameter to less than or equal to a first predetermined value, to obtain a spectrum tilt parameter limit value, and use the spectrum tilt parameter limit value as the time-domain global gain parameter of the high frequency signal; and a second limiting unit 803, configured to: when the current frame of speech/audio signal is a second type of signal, limit the spectrum tilt parameter to a value in a first range, to obtain a spectrum tilt parameter limit value, and use the spectrum tilt parameter limit value as the time-domain global gain parameter of the high frequency signal.

Further, in an embodiment, the first type of signal is a fricative signal, and the second type of signal is a non-fricative signal; when the spectrum tilt parameter tilt>5 and a correlation parameter cor is less than a given value, the narrow frequency signal is classified as a fricative, the rest being non-fricatives; the first predetermined value is 8; and the first preset range is [0.5, 1].

Figure 9:
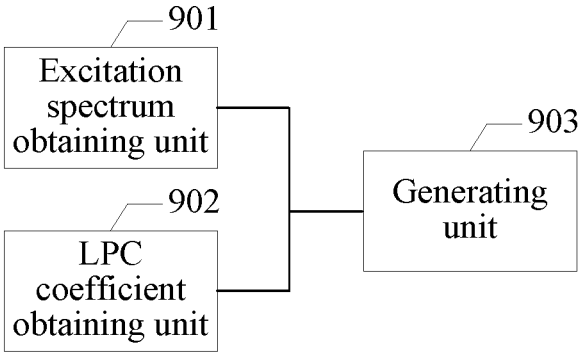
FIG. 9 is a schematic structural diagram of an embodiment of an acquiring unit according to the present invention.

Referring to FIG. 9, in an embodiment, the acquiring unit 601 includes:

an excitation signal obtaining unit 901, configured to predict an excitation signal of the high frequency signal according to the current frame of speech/audio signal;

an LPC coefficient obtaining unit 902, configured to predict an LPC coefficient of the high frequency signal; and a generating unit 903, configured to synthesize the excitation signal of the high frequency signal and the LPC coefficient of the high frequency signal, to obtain the predicted high frequency signal.

In an embodiment, the bandwidth switching is switching from a narrow frequency signal to a wide frequency signal, and the speech/audio signal processing apparatus further includes:

a weighting factor setting unit, configured to: when narrowband signals of the current audio frame of speech/audio signal and a previous frame of speech/audio signal have a predetermined correlation, use a value obtained by attenuating, according to a certain step size, a weighting factor alfa of the energy ratio corresponding to the previous frame of speech/audio signal as a weighting factor of the energy ratio corresponding to the current audio frame, where the attenuation is performed frame by frame until alfa is 0.

Figure 10:
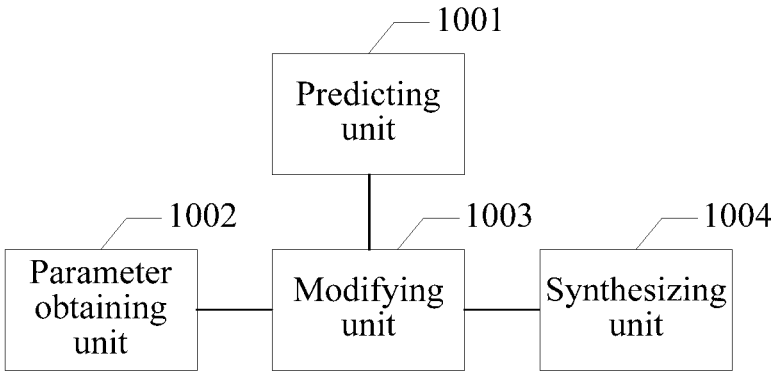
FIG. 10 is a schematic structural diagram of another embodiment of a speech/audio signal processing apparatus according to the present invention.

Referring to FIG. 10, another embodiment of a speech/audio signal processing apparatus includes:

a predicting unit 1001, configured to: when a speech/audio signal switches from a wide frequency signal to a narrow frequency signal, obtain an initial high frequency signal corresponding to a current frame of speech/audio signal;

a parameter obtaining unit 1002, configured to obtain a time-domain global gain parameter of the high frequency signal according to a spectrum tilt parameter of the current frame of speech/audio signal and a correlation between a narrow frequency signal of current frame and a narrow frequency signal of historical frame;

a correcting unit 1003, configured to correct the initial high frequency signal by using the predicted global gain parameter, to obtain a corrected high frequency time-domain signal; and a synthesizing unit 1004, configured to synthesize the narrow frequency time-domain signal of current frame and the corrected high frequency time-domain signal and output the synthesized signal.

Referring to FIG. 8, the parameter obtaining unit 1002 includes:

a classifying unit 801, configured to classify the current frame of speech/audio signal as a first type of signal or a second type of signal according to the spectrum tilt parameter of the current frame of speech/audio signal and the correlation between the current frame of speech/audio signal and the narrow frequency signal of historical frame;

a first limiting unit 802, configured to: when the current frame of speech/audio signal is a first type of signal, limit the spectrum tilt parameter to less than or equal to a first predetermined value, to obtain a spectrum tilt parameter limit value, and use the spectrum tilt parameter limit value as the time-domain global gain parameter of the high frequency signal; and a second limiting unit 803, configured to: when the current frame of speech/audio signal is a second type of signal, limit the spectrum tilt parameter to a value in a first range, to obtain a spectrum tilt parameter limit value, and use the spectrum tilt parameter limit value as the time-domain global gain parameter of the high frequency signal.

Further, in an embodiment, the first type of signal is a fricative signal, and the second type of signal is a non-fricative signal; when the spectrum tilt parameter tilt>5 and a correlation parameter cor is less than a given value, the narrow frequency signal is classified as a fricative, the rest being non-fricatives; the first predetermined value is 8; and the first preset range is [0.5, 1].

Optionally, in an embodiment, the speech/audio signal processing apparatus further includes:

a weighting processing unit, configured to perform weighting processing on an energy ratio and the time-domain global gain parameter, and use an obtained weighted value as a predicted global gain parameter, where the energy ratio is a ratio between energy of a high frequency time-domain signal of historical frame and energy of the initial high frequency signal of current frame; and the correcting unit is configured to correct the initial high frequency signal by using the predicted global gain parameter, to obtain the corrected high frequency time-domain signal.

In another embodiment, the parameter obtaining unit is further configured to obtain a time-domain envelope parameter corresponding to the initial high frequency signal; and the correcting unit is configured to correct the initial high frequency signal by using the time-domain envelope parameter and the time-domain global gain parameter.

A person of ordinary skill in the art may understand that all or a part of the processes of the methods in the embodiments may be implemented by a computer program instructing relevant hardware. The program may be stored in a computer readable storage medium. When the program runs, the processes of the methods in the embodiments are performed. The storage medium may include: a magnetic disk, an optical disc, a read-only memory (Read-Only Memory, ROM), or a random access memory (Random Access Memory, RAM).

The above are merely exemplary embodiments for illustrating the present invention, but the scope of the present invention is not limited thereto. Modifications or variations are readily apparent to persons skilled in the prior art without departing from the spirit and scope of the present invention.

What is claimed:

1. A speech/audio signal processing apparatus, comprising:

means for obtaining an initial high frequency time-domain signal corresponding to a current frame of a speech/audio signal when a signal of the current frame is a narrow frequency signal and a signal of a previous frame is a wide frequency signal, wherein the previous frame is adjacent to the current frame;

means for obtaining a time-domain global gain parameter of the initial high frequency time-domain signal according to a spectrum tilt parameter of the current frame of the speech/audio signal and a correlation between the narrow frequency signal of the current frame and a narrow frequency signal of the previous frame;

means for performing weighting processing on an energy ratio and the time-domain global gain parameter to obtain a weighted value as a predicted global gain parameter, wherein the energy ratio is a ratio between energy of a high frequency time-domain signal of the previous frame and energy of the initial high frequency time-domain signal of the current frame;

means for correcting the initial high frequency time-domain signal by using the predicted global gain parameter to obtain a corrected high frequency time-domain signal;

means for synthesizing a synthesized signal by a narrow frequency time-domain signal of the current frame and the corrected high frequency time-domain signal; and means for outputting the synthesized signal.

2. The apparatus according to claim 1, wherein the means for obtaining the time-domain global gain parameter of the initial high frequency time-domain signal according to the spectrum tilt parameter of the current frame of the speech/audio signal and the correlation between the narrow frequency signal of the current frame and the narrow frequency signal of the previous frame comprises:

means for classifying the current frame of the speech/audio signal as a first type of signal or a second type of signal according to the spectrum tilt parameter of the current frame of the speech/audio signal and the correlation between the narrow frequency signal of the current frame and the narrow frequency signal of the previous frame;

means for limiting the spectrum tilt parameter to less than or equal to a first predetermined value to obtain a first limited spectrum tilt parameter value when the current frame of the speech/audio signal is the first type of signal;

means for limiting the spectrum tilt parameter to a value in a first range to obtain a second limited spectrum tilt parameter value when the current frame of the speech/audio signal is the second type of signal; and means for setting the first limited spectrum tilt parameter value or the second limited spectrum tilt parameter value as the time-domain global gain parameter of the initial high frequency time-domain signal.

3. The apparatus according to claim 2, wherein the means for limiting the spectrum tilt parameter to less than or equal to the first predetermined value to obtain the first limited spectrum tilt parameter value comprises:

means for setting a value of the spectrum tilt parameter as the first limited spectrum tilt parameter value when the value of the spectrum tilt parameter is less than or equal to the first predetermined value; and means for setting a first predetermined value as the first limited spectrum tilt parameter value when the value of the spectrum tilt parameter is greater than the first predetermined value.

4. The apparatus according to claim 2, wherein the means for limiting the spectrum tilt parameter to the value in the first range to obtain the second limited spectrum tilt parameter value comprises:

means for setting a value of the spectrum tilt parameter as the second limited spectrum tilt parameter value when the value of the spectrum tilt parameter belongs to the first range;

means for setting an upper limit of the first range as the second limited spectrum tilt parameter value when the value of the spectrum tilt parameter is greater than the upper limit of the first range; and means for setting a lower limit of the first range as the second limited spectrum tilt parameter value when the value of the spectrum tilt parameter is less than the lower limit of the first range.

5. The apparatus according to claim 2, wherein the first type of signal is a fricative signal and the second type of signal is a non-fricative signal.

6. The apparatus according to claim 2, wherein the first predetermined value is 8 and the first range is [0.5, 1].

7. The apparatus according to claim 1, wherein the means for obtaining the initial high frequency time-domain signal corresponding to the current frame of the speech/audio signal comprises:

means for predicting a high frequency excitation signal according to the current frame of the speech/audio signal;

means for predicting a linear predictive coding (LPC) coefficient; and means for synthesizing the initial high frequency time-domain signal by the high frequency excitation signal and the LPC coefficient.

8. A terminal device comprising:

a memory storage comprising instructions; and one or more processors in communication with the memory storage, wherein the one or more processors execute the instructions to:

obtain an initial high frequency time-domain signal corresponding to a current frame of a speech/audio signal when a signal of the current frame is a narrow frequency signal and a signal of a previous frame is a wide frequency signal, wherein the previous frame is adjacent to the current frame;

obtain a time-domain global gain parameter of the initial high frequency time-domain signal according to a spectrum tilt parameter of the current frame of the speech/audio signal and a correlation between the narrow frequency signal of the current frame and a narrow frequency signal of the previous frame;

perform weighting processing on an energy ratio and the time-domain global gain parameter to obtain an weighted value as a predicted global gain parameter, wherein the energy ratio is a ratio between energy of a high frequency time-domain signal of the previous frame and energy of the initial high frequency time-domain signal of the current frame;

correct the initial high frequency time-domain signal by using the predicted global gain parameter to obtain a corrected high frequency time-domain signal;

synthesize a synthesized signal by a narrow frequency time-domain signal of the current frame and the corrected high frequency time-domain signal; and output the synthesized signal.

9. The terminal device according to claim 8, wherein the one or more processors execute the instructions to:

classify the current frame of the speech/audio signal as a first type of signal or a second type of signal according to the spectrum tilt parameter of the current frame of the speech/audio signal and the correlation between the narrow frequency signal of the current frame and the narrow frequency signal of the previous frame;

when the current frame of the speech/audio signal is the first type of signal, limit the spectrum tilt parameter to less than or equal to a first predetermined value to obtain a first limited spectrum tilt parameter value;

when the current frame of the speech/audio signal is the second type of signal, limit the spectrum tilt parameter to a value in a first range to obtain a second limited spectrum tilt parameter value; and set the first limited spectrum tilt parameter value or the second limited spectrum tilt parameter value as the time-domain global gain parameter of the initial high frequency time-domain signal.

10. The terminal device according to claim 9, wherein the one or more processors execute the instructions to:

set a value of the spectrum tilt parameter as the first limited spectrum tilt parameter value when the value of the spectrum tilt parameter is less than or equal to the first predetermined value; and set a first predetermined value as the first limited spectrum tilt parameter value when the value of the spectrum tilt parameter is greater than the first predetermined value.

11. The terminal device according to claim 9, wherein the one or more processors execute the instructions to:

set a value of the spectrum tilt parameter as the second limited spectrum tilt parameter value when the value of the spectrum tilt parameter belongs to the first range;

set an upper limit of the first range as the second limited spectrum tilt parameter value when the value of the spectrum tilt parameter is greater than the upper limit of the first range; and set a lower limit of the first range as the second limited spectrum tilt parameter value when the value of the spectrum tilt parameter is less than the lower limit of the first range.

12. The terminal device according to claim 9, wherein the first type of signal is a fricative signal and the second type of signal is a non-fricative signal.

13. The terminal device according to claim 9, wherein the first predetermined value is 8 and the first range is [0.5, 1].

14. The terminal device according to claim 8, wherein the one or more processors execute the instructions to:

predict a high frequency excitation signal according to the current frame of the speech/audio signal;

predict a linear predictive coding (LPC) coefficient; and synthesize the initial high frequency time-domain signal by the high frequency excitation signal and the LPC coefficient.

* * * * *